United States Patent [19]

Schmidt

[11] Patent Number: 4,938,297

[45] Date of Patent: Jul. 3, 1990

[54] RAM BORING MACHINE

[76] Inventor: Paul Schmidt, Reiherstr. 1, 5940 Lennestadt 1 (Saalhausen), Fed. Rep. of Germany

[21] Appl. No.: 223,287

[22] Filed: Jul. 22, 1988

[30] Foreign Application Priority Data

Jul. 25, 1987 [DE] Fed. Rep. of Germany ..... 3724619
Oct. 16, 1987 [DE] Fed. Rep. of Germany ..... 3735018

[51] Int. Cl.[5] ..... E21B 4/14; E21B 7/08

[52] U.S. Cl. ..... 175/19; 173/91; 173/133; 175/73; 175/74; 175/92; 175/296

[58] Field of Search ..... 175/74, 73, 19, 92, 175/256, 263, 267, 271, 273, 286, 293, 296, 384, 389, 390, 382, 61; 173/91, 132, 133

[56] References Cited

U.S. PATENT DOCUMENTS

| | | | |
|---|---|---|---|
| 3,667,556 | 6/1972 | Henderson | 175/73 |
| 3,677,354 | 7/1972 | Kostylev et al. | 175/61 X |
| 4,319,649 | 3/1982 | Jeter | 175/73 |
| 4,396,073 | 8/1983 | Reichman et al. | 175/74 |
| 4,655,299 | 4/1987 | Schoeffler | 175/38 |

FOREIGN PATENT DOCUMENTS

| | | | |
|---|---|---|---|
| 865954 | 7/1978 | Belgium . | |
| 865955 | 7/1978 | Belgium . | |
| 1175161 | 7/1964 | Fed. Rep. of Germany . | |
| 2157259 | 11/1972 | Fed. Rep. of Germany . | |
| 2242605 | 3/1974 | Fed. Rep. of Germany . | |
| 8703924 | 7/1987 | PCT Int'l Appl. | 175/73 |
| 823566 | 4/1981 | U.S.S.R. | 175/293 |
| 1303547 | 1/1973 | United Kingdom . | |

*Primary Examiner*—Hoang C. Dang
*Attorney, Agent, or Firm*—Toren, McGeady & Associates

[57] ABSTRACT

A pressure-medium driven ram boring machine for boring in the earth, having an impact tip acted on by a percussion piston reciprocating in the machine housing, wherein the impact tip is arranged to be radially adjustable in the housing whereby controlled directional changes of the machine can be effected.

4 Claims, 11 Drawing Sheets

305
302
327
324
327
326
325
327

35
302
38
40
39
31
32
323
37
36
34
30
39
320
321
33
X
X
327
324
316
303
326
305
304

302
324
327
326
305
325

301
302
35
37
36
P1
38
39
40
39
30
320
321
32
33
323
305
XII
XII
327
324
326
316
303
304

RAM BORING MACHINE

TECHNICAL FIELD OF THE INVENTION

The invention relates to a pressure-medium driven ram boring machine for boring in the earth having an impact tip acted on by a percussion piston reciprocating in the machine housing.

BACKGROUND OF THE INVENTION AND PRIOR ART

A ram boring machine of this kind is known from German Patent 21 57 295. It is mainly used to lay supply lines such as, for example, water pipes or cables beneath roads or embankments or other buildings and obstacles without having to tear up the surface of the road or ground at the same time. The way this is done is that the ram boring machine, in moving forwards in the ground, pushes the earth to the side and leaves a tunnel behind it into which the supply line is simultaneously or subsequently drawn. The impact tip serves to shatter stones or other obstacles during the forward movement of the ram boring machine and to push them aside, i.e. drive a passage for the housing moving up behind. However, it is not always possible to prevent the ram boring machine from moving out of the desired direction when it strikes an obstacle.

A ram boring machine whose course can be directed is known from German Offenlegungsschrift 22 42 605 and has a tubular, curved extension on its rear end which is also provided with curved guide surfaces as a means of obtaining a curved boring course in the earth. It is necessary to produce curved bores of this kind if, for example in narrow roads with narrow sidewalks, it is not possible to dig out starting and finishing pits at least deep enough for the ram boring machine to be set up horizontally in the starting pit and, in addition, still pass underneath all the other lines lying beneath the surface of the road. The rigid deflectors enable a curved boring course to be obtained that is decided before the machine is started, but during operation the direction cannot be influenced.

OBJECT OF THE INVENTION

The object of the invention is to provide a ram boring machine with which deliberate changes in direction can be made.

SUMMARY OF THE INVENTION

This object is achieved according to the invention if the impact tip is arranged in the housing so as to be radially adjustable. The radial adjustment enables the impact tip, which can either be arranged to be longitudinally displaceable in the housing or rigidly attached to the housing, to be displaced as desired from its normal central position in the housing if it is diverted from its straight direction of advance in either a horizontal or vertical plane, so as to counteract the directional deviation correspondingly. Directional deviations can, for example, be recorded by an instrument arranged on the ram boring machine and read at a remote control console by an operator. In the event of directional changes, the operator can instigate the corresponding correction from the control desk, for example, by means of hydraulic or pneumatic pressure lines connected to the impact tip.

The impact tip is advantageously mounted in an adjusting eccentric preferably comprising two mutually pivotable eccentric rings fitted radially one within the other. The eccentric rings can advantageously be pivoted about the stem of the impact tip hydraulically owing to the relatively large forces that can be exerted in this way. The impact tip can thus be adjusted as desired to a position diverging from the central position. With two or more eccentric rings a more sensitive, i.e. more accurate, adjustment over a larger range of adjustment can be achieved than with one eccentric ring. Preferably pressure lines connected to supply connections and arranged in the housing lead to the eccentric rings. The eccentric rings can be adjusted by supplying hydraulic fluid through the supply lines connected to the rear end of the ram boring machine.

In order to adjust the impact tip from its central position, according to another embodiment, a plurality of adjusting pistons can be provided, arranged in a radial plane about the stem of the impact tip. In this case, three pistons which can be acted on independently from one another can advantageously be arranged around the circumference and can be connected to supply connections by means of pressure lines arranged in the housing of the ram boring machine. Whilst the piston of one pump is being acted on so as to press against the stem, e.g. through a shell, and move the tip out of its central position, the pistons of the other pumps correspondingly travel into the pump housing or the cylinder space, i.e. the stem and the impact tip are positioned by means of the coordinated adjusting movements of the piston pumps.

By means of an unlockable arresting sleeve, advantageously cooperating with a pressure spring, which surrounds a centering ring of the stem of the impact tip when the impact tip is in the central position, it is ensured that the ram boring machine runs straight ahead when the pistons are in a pressureless condition. That is to say, during normal operation the impact tip is secured in its central position from which it can only be displaced when directional changes are desired, which entails first unlocking the arresting sleeve against the force of the pressure spring. The arresting sleeve can be moved from its position surrounding the centering ring by supplying a pressure medium such as hydraulic fluid to a cylinder space accommodating the arresting sleeve.

The arresting sleeve can advantageously comprise an axially displaceable control valve spool which, in an extension stem which can be acted on by a pressure medium, has an axial central bore and radial distributor bores, corresponding to the number of pistons to be supplied, which can be connected to control lines of the piston. In this case all the pistons can be supplied with hydraulic fluid by only one pressure line leading from the rear end through the housing of the ram boring machine, since the control valve spool is pushed axially forward, depending on the adjustable pressure on the extension stem acting as a piston, until a flow connection is formed which connects the central bore to the radial distributor bore and to the control line of the controlled piston. The radial distributor bores are distributed circumferentially in the extension stem spaced from one another.

In another embodiment, axially displaceable adjusting pistons with inclined piston surfaces can abut against corresponding oppositely inclined surfaces at the end of the stem of the impact tip. The radial adjustment of the impact tip is thus achieved by displacing at least one of the pistons in the opposite direction to the direction of displacement of the other pistons, i.e. all the pistons are moved out of their starting positions defined by the central position of the impact tip with, however, at least one piston moving in a different direction to the other pistons. By means of the inclined planes defined by the correspondingly inclined surfaces, any desired radial displacements can be carried out.

The adjusting pistons can be supported against pressure springs which are advantageously arranged in recesses in a centering shell which fits closely around a spherical thickening of the stem. During normal operation of the ram boring machine, i.e. as long as no directional changes are necessary, the pressure springs hold the impact tip in its central position, in which the force of the spring corresponds to the pressure acting on the pistons, i.e. the pistons are held between the spring pressure and the fluid pressure. When displacing the impact tip from the central position, one of the pistons is subjected to a pressure exceeding the force of the spring while the other adjusting pistons are pressureless. The pressureless pistons are moved out of their starting positions by the relaxing pressure springs in the opposite direction to the adjusting piston subjected to higher pressure. After the directional correction, all the pistons are subjected to the same pressure corresponding to the force of the spring. The compressed spring then relaxes while the relaxed springs are compressed until the pistons reach their starting position; the springs guide the pistons back to their starting position.

According to another embodiment rubber bellows, preferably pneumatically inflatable, can be arranged in a radial plane around the stem of the impact tip. The force of reaction caused by inflation of the rubber bellows supported in the housing of the ram boring machine causes a movement which displaces the impact tip from its central position.

In the case of a ram boring machine not provided with integrated control elements, deliberate directional changes are achieved according to the invention by a tubular shell enveloping the machine housing, preferably spaced radially therefrom, and by adjusting elements acting or arranged between the housing surface and the tubular shell. Since ram boring machines that are already in use but do not have directional control can only be converted to directional control at great expense, the invention thus also enables machines of this kind to be controlled by displacing the whole machine radially. The adjusting elements such as, preferably, at least one adjusting eccentric accommodating the machine housing or a plurality of adjusting pistons which can be acted on independently of one another or inflatable rubber bellows arranged in a radial plane about the machine housing are associated with but outside the machine housing. The inside of the machine thus remains totally unaffected, i.e. the adjusting elements and the machine housing are enclosed by the tubular shell.

In this way, ram boring machines that previously did not have directional control can be influenced positively during their forward movement. In addition steerable ram boring machines can equally well be provided with an encasing tubular shell and adjusting elements arranged on the outside, i.e. in the space between the surface of the housing and the tubular shell, and can thus produce earth bores of larger diameter. All that is needed is for a correspondingly larger head accommodating the impact tip and adapted to the larger diameter of the tubular shell to be attached to the machine and for the supply connections connected to the machine housing to be joined to the pressure lines arranged in the tubular shell supplying the adjusting elements.

The machine housing is preferably mounted in two adjusting eccentrics spaced axially from one another, preferably comprising two mutually pivotable eccentric rings fitted one within the other, the respective inner and outer eccentric rings being connected to one another. Owing to the two adjusting eccentrics there is a two-point bearing or support of the ram boring machine; in addition the frictional resistance that has to be overcome when acting on the adjusting eccentric, i.e. when rotating the eccentric rings, is smaller than with only one adjusting eccentric, which would have to be made correspondingly wider.

The respective inner and outer eccentric rings of the two adjusting eccentrics can advantageously be connected to one another by tubes. The connecting tube bridging the space between the two adjusting eccentrics ensures that the eccentric rings of the two adjusting eccentrics turn together when swivelling the ram boring machine about its central position.

In the case of a ram boring machine mounted in two adjusting eccentrics spaced from one another, the adjusting eccentrics are preferably arranged so that they can counter-rotate. By adjusting one adjusting eccentric to an eccentricity in the opposite direction to the eccentricity of the other adjusting eccentric, for example so that the one adjusting eccentric has the largest eccentricity downwards and the other adjusting eccentric has the largest eccentricity upwards, the ram boring machine can be brought into any desired inclined position in the tubular shell and can thus cause the desired directional change. Compared with swivelling the ram boring machine about the centre axis, the angular adjustment of the ram boring machine enables greater directional changes or corrections to be made.

In the case of adjusting eccentrics which can counter-rotate, the inner eccentric rings of the adjusting eccentrics preferably abut against spherical housing shells of the machine. The housing shells which are, for example, shrunk onto the machine housing, have a suitable convex outer contour to fit against concave surfaces of the inner eccentric rings, and the curved contact surfaces enable the ram boring machine to be adjusted to any desired angular position.

BRIEF DESCRIPTION OF THE DRAWINGS

The invention will now be described in more detail with reference to several exemplary embodiments shown in the drawings, in which.

DETAILED DESCRIPTION OF PREFERRED EMBODIMENTS OF THE INVENTION

Figure 1:
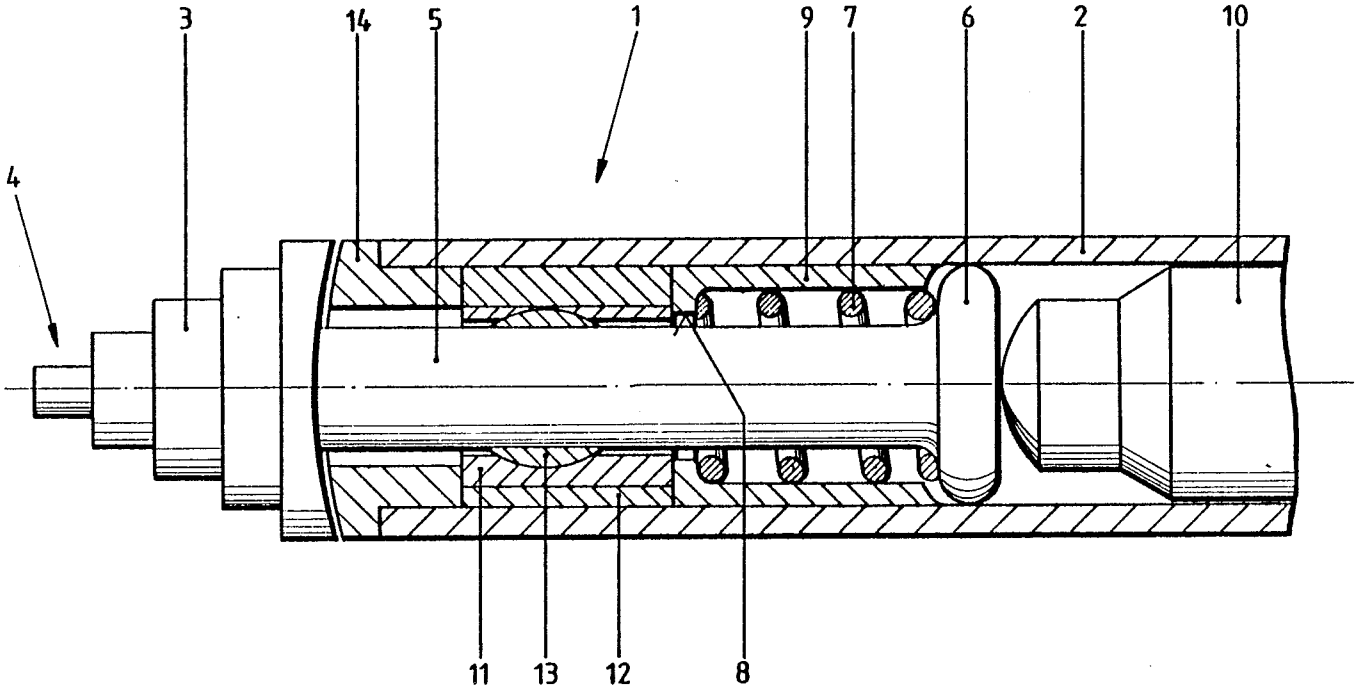
FIG. 1 shows in longitudinal section the front end of a ram boring machine having a longitudinally dsplaceable impact tip mounted according to the invention in an adjusting eccentric.

The front end of a ram boring machine 1 shown in FIG. 1 has an impact tip 4 mounted to be axially displaceable in the tubular housing 2 of the ram boring machine with its part projecting from the housing 2 formed as a stepped head 3. The impact tip 4 extends with a stem 5 in the inside of the housing 2; the stem 5 has a collar 6 on its end remote from the stepped head 3. The impact tip 4 is acted on by a spring 7 which is supported on the one side against the collar 6 and on the other side against the inner collar 8 of a bush 9. The impact tip 4 is pushed forwards by the action of a percussion piston 10 guided axially in the housing against the force of the compressing spring 7 and thus works its way into the earth. The stepped head 3 provided with a chisel shatters the stones and other obstacles in the process and pushes the earth aside; only after this is the housing 2 drawn up. In order to act on the percussion pistons 10 with compressed air there is at the rear end of the ram boring machine 1 (not shown) a reversible pressure means connection supplied by a compressor. With axial forward acceleration the percussion piston 10 strikes the collar 6 and in doing so imparts its impact energy to the impact tip 4.

The stem 5 is mounted in eccentric rings 11, 12 fitted radially one within the other, i.e. an outer eccentric ring 12 surrounds an inner eccentric ring 11. In order to support the non-tilting guidance of the stem 5, spherical shells 13 lie like laminate on part of the cylindrical surface of the stem 5 and are accommodated in a matching recess in the inner eccentric ring 11. The eccentric rings 11, 12 abut at one end against the sleeve 9 and at the other end against an end bush 14 inserted, for example screwed, into the front end of the housing and are thus secured against axial movement. However, the eccentric rings 11, 12 can rotate radially relative to one another and thereby displace the impact tip 4 from its central position shown in FIG. 1 to any desired eccentric position.

Figure 2B:
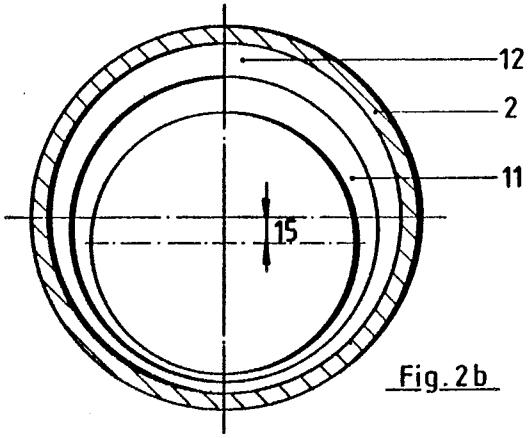
FIGS. 2*a* to 2*d* show various positions of two eccentric rings fitted radially one within the other.
Figure 2D:
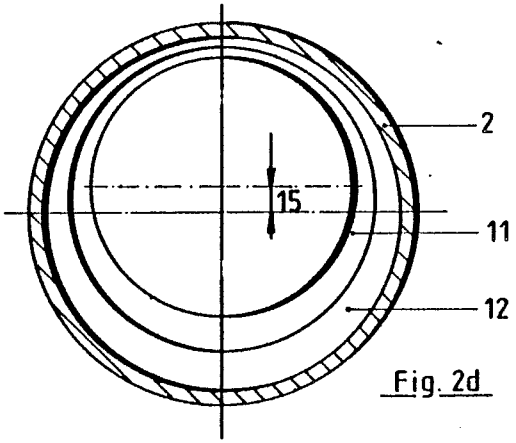
Figure 2A:
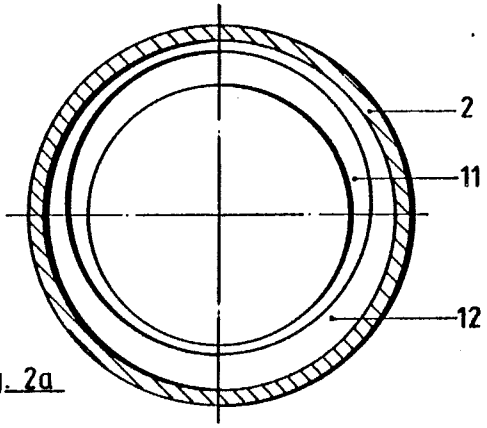
Figure 2C:
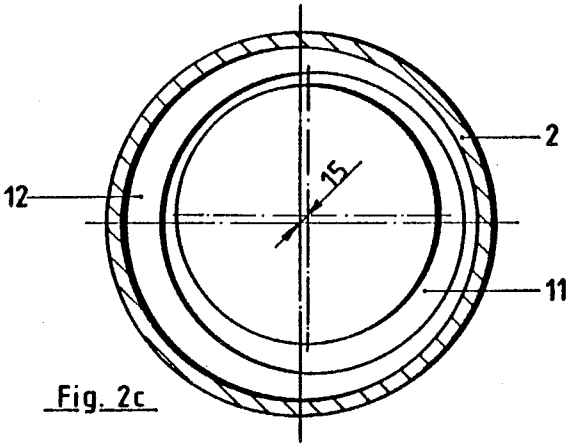

The positions into which the impact tip 4 can be adjusted by the eccentric rings 11, 12 are shown diagrammatically in FIGS. 2*a* to 2*d*, wherein the position of the eccentric rings 11, 12 in FIG. 2*a* is equivalent to the zero position, i.e. the central position, in FIG. 2*b* it is equivalent to the maximum downward eccentricity 15 and in FIG. 2*d* is equivalent to the maximum upward eccentricity 15. In FIG. 2*c* the eccentricity 15 is shown in an arbitrary position of the eccentric rings 11, 12.

Unlike the ram boring machine 1 shown in FIG. 1 which has an impact tip which moves longitudinally whereby a two-beat operating rhythm results in which with the first beat the percussion piston 10 knocks the impact tip 4 with the stepped head 3 forward so that a pilot bore is formed in the earth, then with the second beat thrusts the whole ram boring machine 1 into this pilot bore. The ram boring machines 101, 301, and 401 shown in FIGS. 4, 5 and 9 to 15 are machines in which the housing and stepped head 102, 103; 302, 303 and 402, 403 respectively are integral. In the case of these ram boring machines 101, 301, 401 having a rigid head, i.e. one that cannot move longitudinally, the percussion pistons 110, 310, 410 push the whole machine forwards with one blow.

Figure 3:
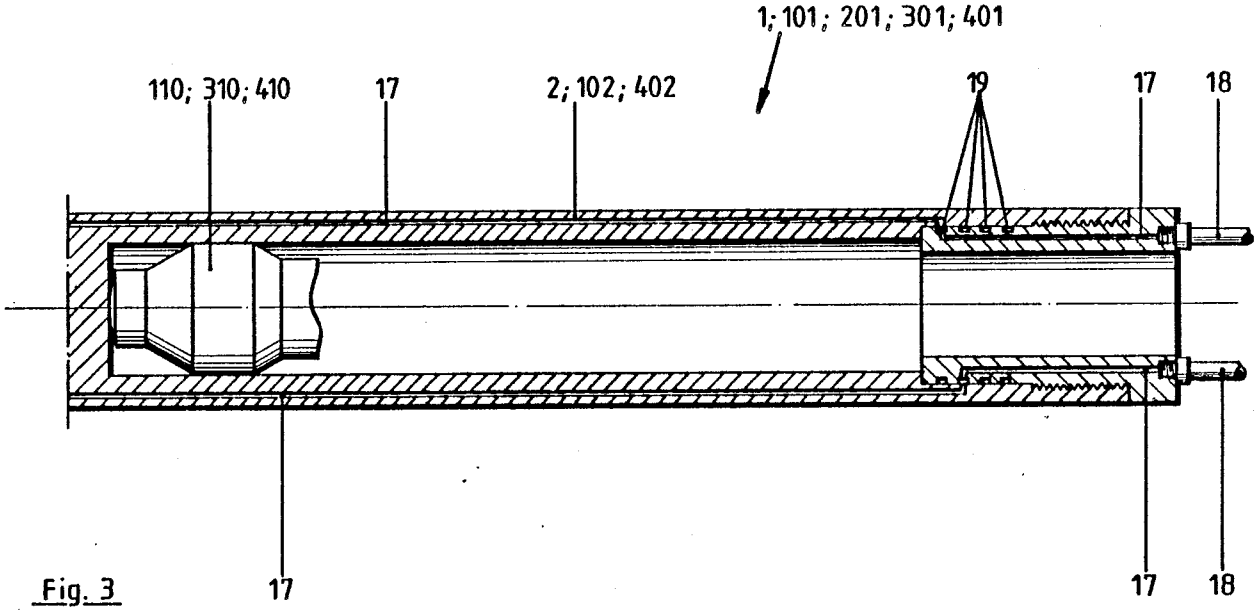
FIG. 3 shows in longitudinal section the rear end of a ram boring machine having connections and pressure lines to supply the pressure means causing the adjusting movements of the impact tip.
Figure 4:
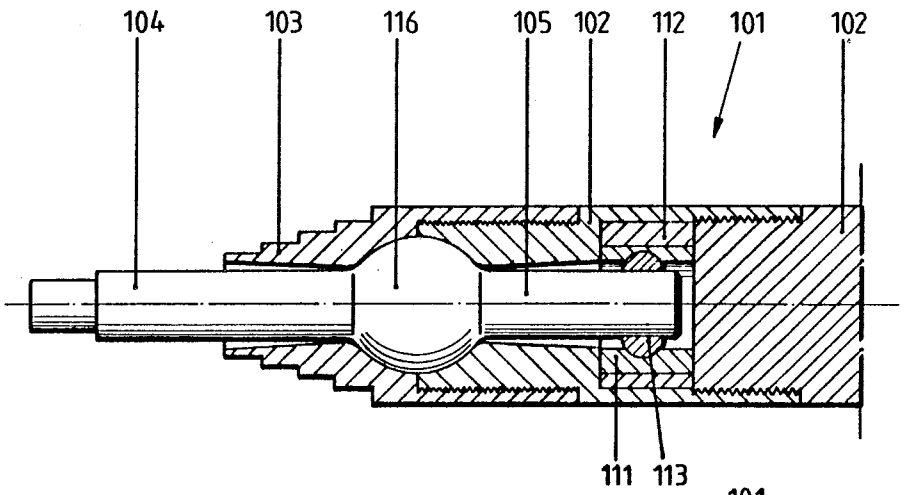
FIG. 4 shows in longitudinal section the front end of a ram boring machine having a rigid impact tip mounted in adjusting eccentrics arranged in a stepped head integral with the housing.
Figure 5:
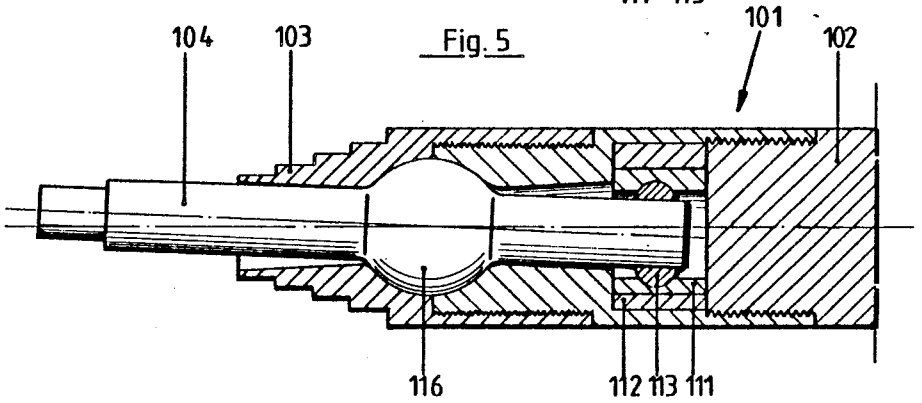
FIG. 5 shows the impact tip according to FIG. 4 in a position displaced from its central position.

As shown in FIGS. 4 and 5 the impact tip 104 has a spherical thickening 116 with which the impact tip 104 is mounted in the inside of the housing. The stem 105 of the impact tip 104 extending in the housing 102 is arranged in eccentric rings 111, 112 fitted radially one within the other and is supported over part of its surface for swivel-free guidance by spherical shells 113 which fit into a matching recess in the inner eccentric ring 111. In order to displace the impact tip 104 from its central position to the eccentric position shown in FIG. 5, the eccentric rings 111, 112 are displaced relative to one another by a pressure medium such as, in particular, hydraulic fluid. As shown in FIG. 3, the hydraulic fluid is supplied through pressure lines 17 which are arranged in the housing 2, 102 in a number corresponding to the number of control nozzles (not shown) aimed at the eccentric rings 11, 12 and 111, 112. The pressure lines extend from the rear end of the ram boring machine 1, 101 to the front; at the rear end of the ram boring machine 1, 101 they are connected to supply lines 18 supplied by a hydraulic tank (not shown). The hydraulic fluid flowing in by way of the supply connections 18 is distributed by means of grooves 19 associated with each pressure line 17.

Figure 7:
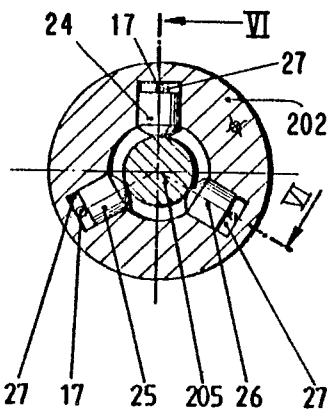
FIG. 7 shows the ram boring machine of FIG. 6 sectioned along the line VII—VII of FIG. 6.
Figure 6:
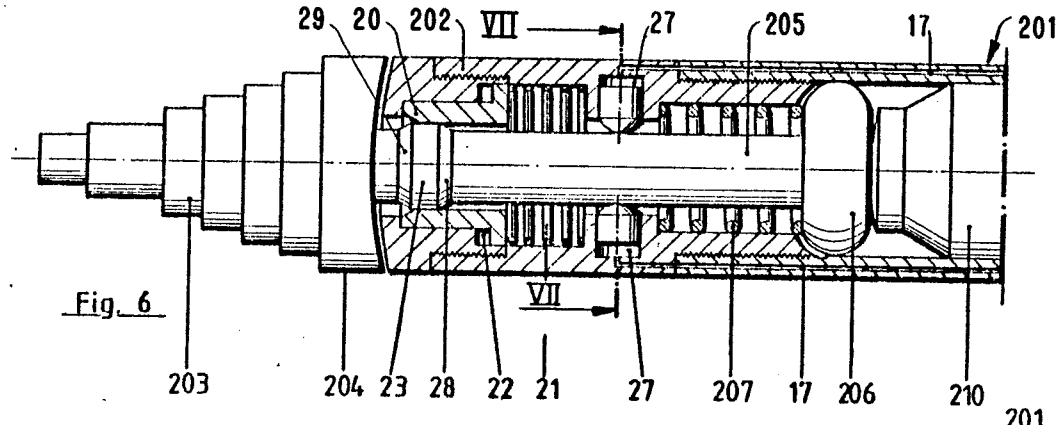
FIG. 6 shows in longitudinal section on the line VI—VI in FIG. 7 the front end of a ram boring machine having a longitudinally movable impact tip with a stepped head and adjusting pistons arranged radially about a stem of the impact tip according to the invention.
Figure 8:
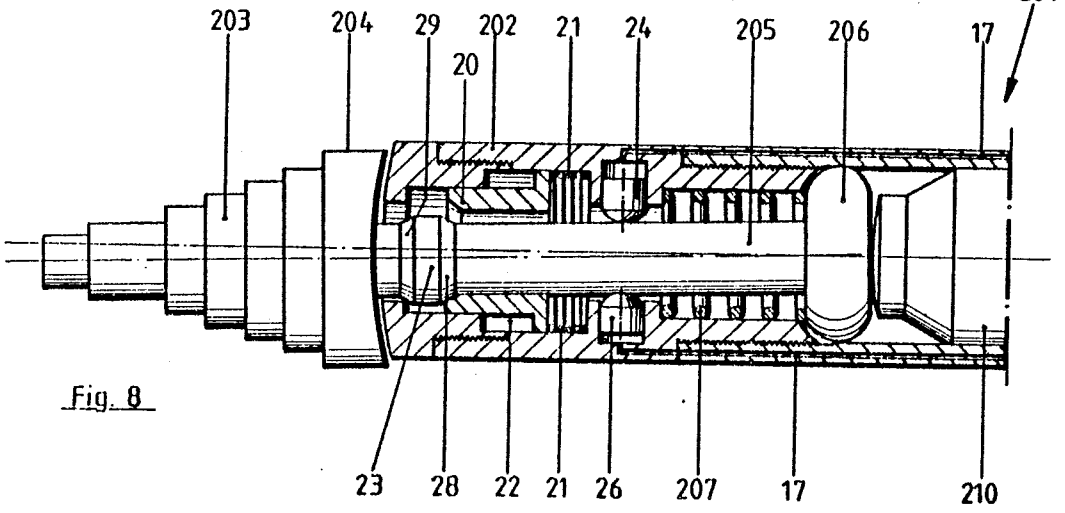
FIG. 8 shows the ram boring machine of FIG. 6 with its impact tip displaced from its central position.

In FIGS. 6 to 8 a ram boring machine 201 having a longitudinally displaceable impact tip 204 provided with a stepped head 203 is shown. During normal operation, i.e. whilst the ram boring machine 201 is moving straight ahead, the impact tip 204 of the ram boring machine 201 is held in the central position by an arresting sleeve 20. For this purpose a pressure spring 21 pushes the arresting sleeve 20, which is axially displaceable in a cylinder space 22, over a centering ring 23 arranged on the end of the stem 5 of the impact tip 204 remote from the collar 206. Arranged about the stem 205, in a radial plane, are three adjusting pistons 24, 25, 26 (FIG. 7) whose cylinder spaces 27 are connected via pressure lines 17 to supply connections 18 (cf. FIG. 3) arranged at the rear end of the ram boring machine 201.

In order to displace the impact tip 204 radially from its central position as in FIG. 6 to the eccentric position shown in FIG. 8, the cylinder space 22 is pressurised by hydraulic fluid supplied via a hydraulic line (not shown) and the arresting sleeve 20 is pushed, against the force of the pressure spring 21, away from the centering ring 23. By subsequent action on one of the adjusting pistons 24 to 26 the impact tip 204 is displaced to the desired eccentric position; in the eccentric position of the impact tip 204 shown in FIG. 8, the adjusting piston 24 acts on the stem 205, and therefore on the impact tip 204, with greater force than the adjusting pistons 25, 26. The adjusting pistons 25, 26 can possibly be completely unpressurised, in which case the hydraulic fluid flows out of the cylinder spaces 27 via return lines (not shown). After the directional correction the cylinder space 22 of the arresting sleeve 20 is unloaded so that the consequently relaxing pressure spring 21 pushes the arresting sleeve 20 onto the centering ring 23 and determines the central position of the impact tip 204. The centering ring 23 and the arresting sleeve 20 both have inclined guiding surfaces 28, 29 respectively, which help to push the arresting sleeve 20 over the ring. The arresting sleeve 20 holding the impact tip 204 in the central position enables the adjusting pistons 24 to 26 to be pressureless during the arrest, i.e. pressure only acts on the adjusting pistons when there is a change in direction.

The ram boring machine 301 having a rigid, i.e. not longitudinally movable, impact tip 304 according to FIGS. 9 to 12 has adjusting pistons 324, 325, 326 arranged in a radial plane about the stem 305 of the impact tip 304 as well as an arresting sleeve 320 formed as a control valve spool 30. The arresting sleeve 320 of the control valve spool 30 accommodates a pressure spring 321 in a space 31 which, in the central position shown in FIG. 9, holds a floating limiting disc 32, also arranged in the space 31, up against a tapered mouthpiece 33 of the arresting sleeve 320. In this position the mouthpiece 33 clasps a centering ring 323 which is located on the end of the stem 305 of the impact tip 304 remote from the spherical thickening 316. The arresting sleeve 320 continues on the side remote from the mouthpiece 33 as an extension stem 34 which projects into a cylinder space 36 connected to a source of pressure (not shown) by way of a pressure line 35. The extension stem 34 is provided with an axial central bore 37 as well as radial distributor bores 38 arranged around its circumference and spaced axially from one another. A control line 39 leads from each cylinder space 327 of the adjusting pistons 324, 325, 326 to the extension stem 34 of the control valve spool 30. The control lines 39, of which, in the longitudinal sections according to FIGS. 9 and 11, only the control lines 39 associated with the adjusting pistons 324 and 326 are shown, can be connected as desired to the radial distributor bores 38 of the extension stem 34.

Figures 9, 10:
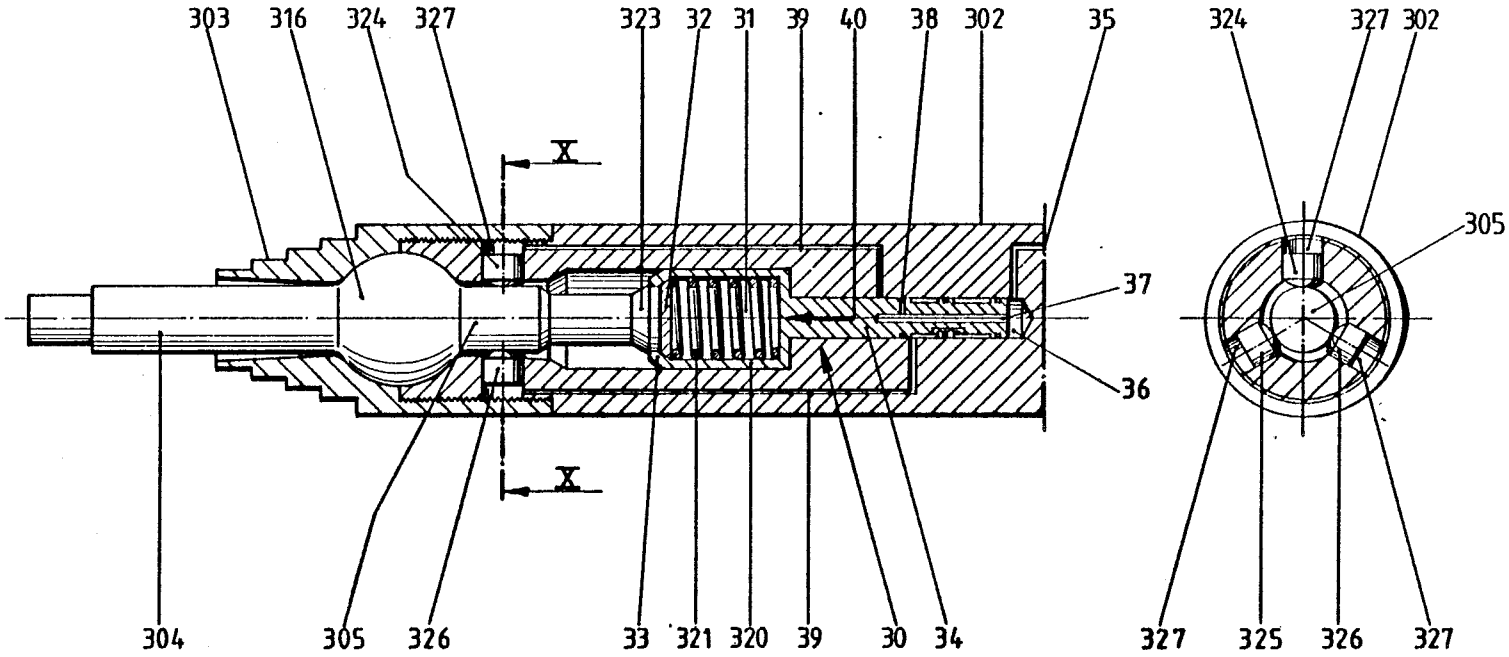
FIG. 9 shows in longitudinal section the front end of a ram boring machine having a rigid stepped head, i.e. one integral with the housing, and an impact tip arranged therein which has, at the end of a stem projecting into the housing, a centering ring surrounded by an arresting sleeve comprising a control valve spool.
FIG. 10 shows the ram boring machine according to FIG. 9, sectioned along the line X—X in FIG. 9.
Figures 11, 12:
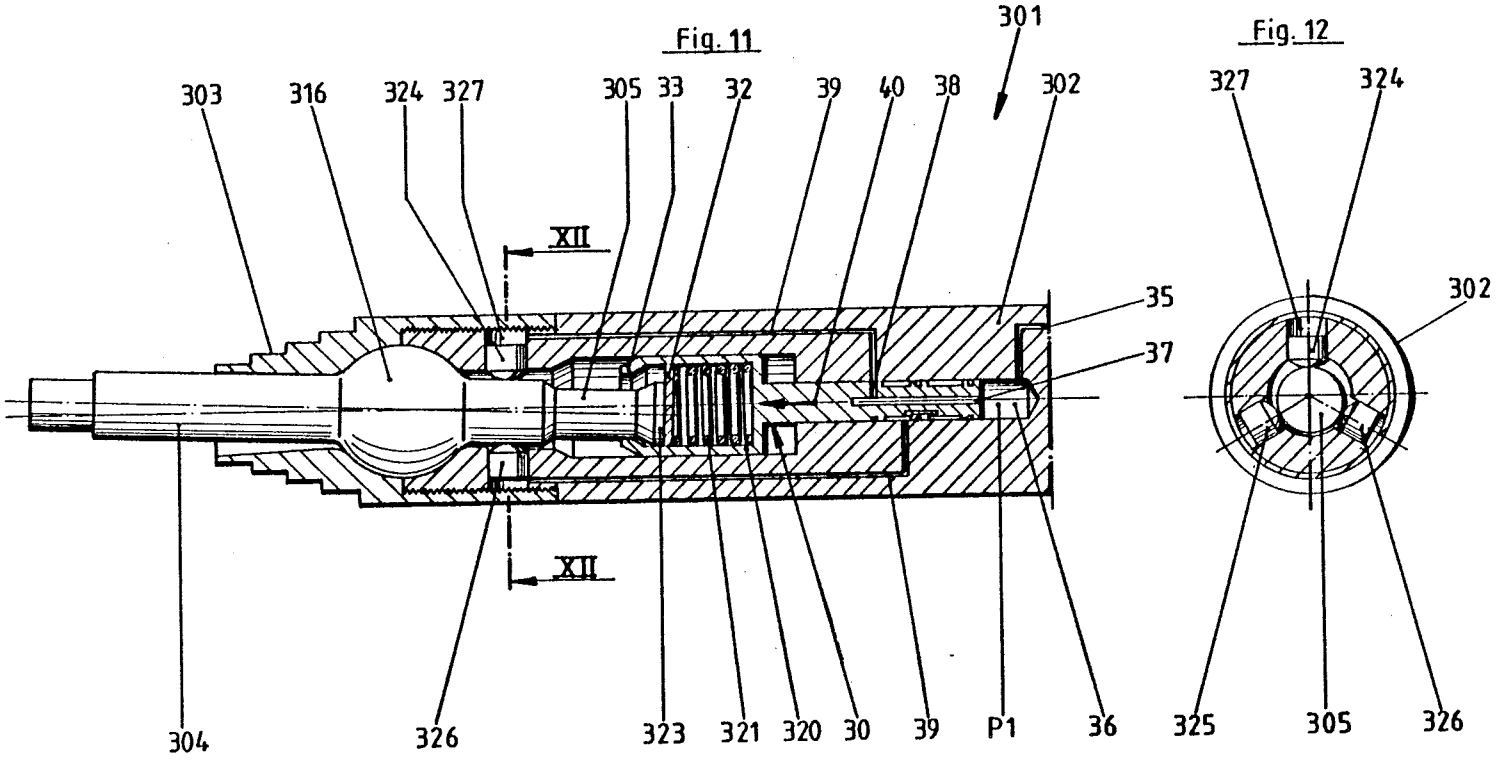
FIG. 11 shows the ram boring machine according to FIG. 9 with its impact tip displaced from central position.
FIG. 12 shows the ram boring machine according to FIG. 11, sectioned along the line XII—XII in FIG. 11.

In order to displace the impact tip 304 to the eccentric position shown in FIG. 11, the line 35, which in FIG. 9 is pressureless, is first acted on by a pressure $P_0$ whereupon the pressure spring 321 is compressed and the control slide 30 is displaced in the direction of the arrow 40. The mouthpiece 33 of the arresting sleeve 320 is thereby pushed over the centering ring 323 of the stem 305 of the impact tip 304, i.e. the centering ring 323 together with the limiting disc 32, penetrates relatively further into the space 31 of the arresting sleeve 320; the seating of the arresting sleeve 320 and the centering ring 323 preventing displacement of the impact tip 304 from the central position is broken. By increasing the pressure in the line 35 to the amount $P_1$ the control valve spool 30 moves further forward in the direction of the arrow 40 until the control line 39 of the adjusting piston 324 is connected to the radial bore 38 associated with the piston 324. The pressure fluid then flows out of the central bore 37 of the extension stem 34 via the distributor bore 38 and the control line 39 into the compression space 327 of the adjusting piston 324. By increasing the pressure of the pressure fluid supplied by way of the line 35 to the amount $P_2$, $P_3$,...$P_n$ control lines 39 of any desired adjusting piston can be connected to the flow of pressure fluid by corresponding positional changes of the control valve spool 30 so that a displacement of the impact tip 304 can be achieved.

In the case of the eccentric position of the impact tip 304 shown in FIG. 11 the pressure in the cylinder space 36 is $P_1$, i.e. there is a flow connection between the pressure line 35 and the cylinder space 327 of the adjusting piston 324 by way of the distributor bore 38 and control line 39 associated with the adjusting piston 324. The adjusting piston 324 acted on by pressure moves the impact tip 304, in its spherical joint defined by the spherical thickening 316, into the desired eccentric position. After the directional correction the pressure line 35 is switched so as to become pressureless; the consequently relaxing pressure spring 321 moves the control valve spool counter to the direction of the arrow 40 back into its starting position shown in FIG. 9 in which the mouthpiece 33 of the arresting sleeve 320 clasps the centering ring 323 and prevents any radial displacement of the impact tip 304. In the case of the ram boring machine 301 provided with the control valve spool 30 any number of adjusting pistons can be supplied via only one pressure line 35 guided from the rear end of the ram boring machine 301 through the housing 302 to the cylinder space 36 of the control valve spool 30; in addition it only needs one return line.

Figure 14:
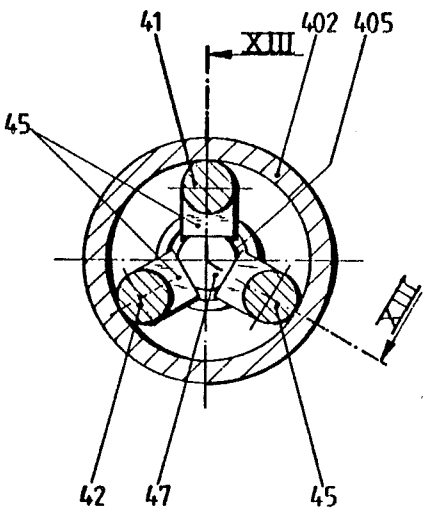
FIG. 14 shows the ram boring machine according to FIG. 13 sectioned along the line XIV—XIV in FIG. 13.
Figure 13:
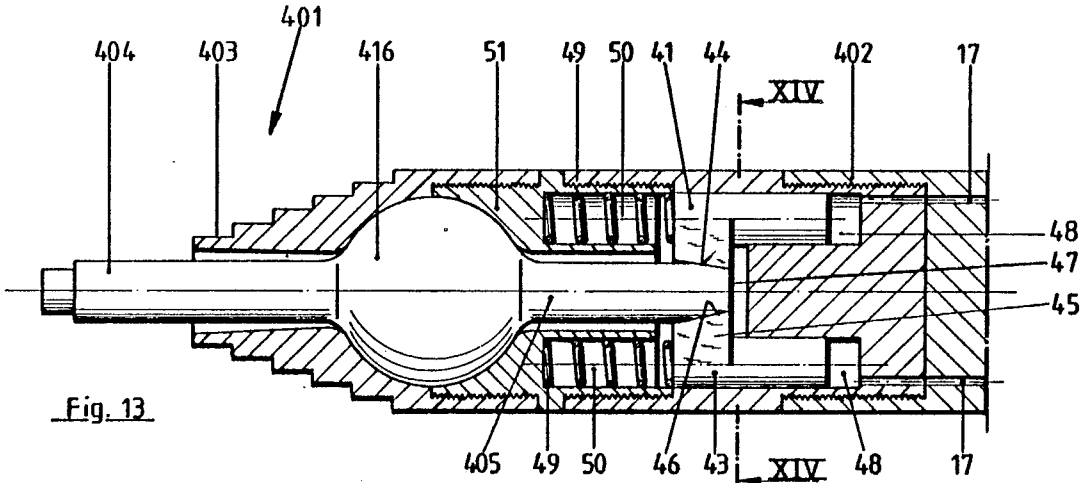
FIG. 13 shows the front end of a ram boring machine having a rigid stepped head and an impact tip arranged therein which has, at the end of a stem projecting into the housing, inclined surfaces which correspond to inclined surfaces of axially displaceable adjusting pistons, sectioned along the line XIII—XIII in FIG. 14.
Figure 15:
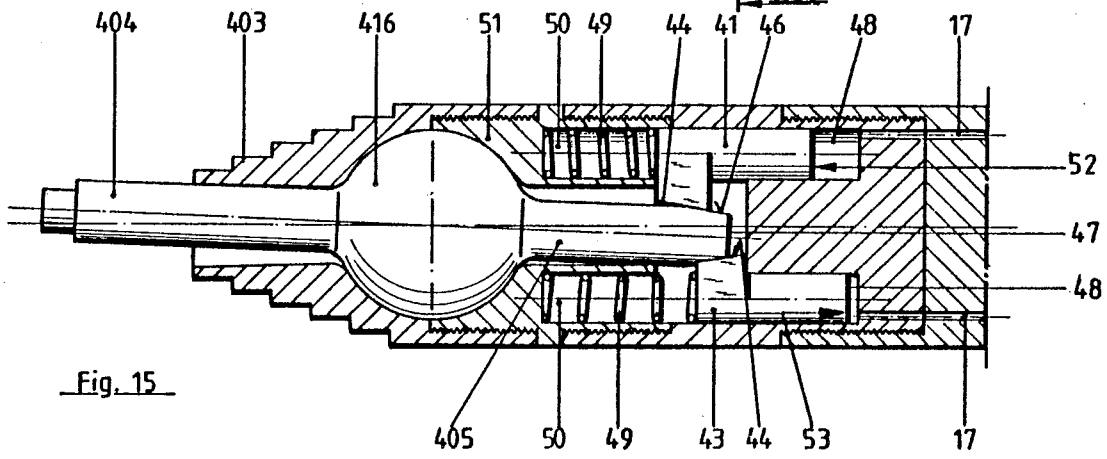
FIG. 15 shows the ram boring machine according to FIG. 13 with its impact tip displaced the central position, FIG. 16 in longitudinal section a tubular shell having two simultaneously adjustable adjustment eccentrics holding a ram boring machine in the central position.

In the embodiment of the ram boring machine 401 shown in FIGS. 13 to 15 having an impact tip 404 that is not longitudinally displaceable, three axially displaceable adjusting pistons 41, 42, 43 are arranged in a radial plane about the end of the stem 405 of the impact tip 404 lying in the inside of the ram boring machine 401. The adjusting pistons 41, 42 43 abut with inclined piston surfaces 44 of radial piston projections 45 against correspondingly counter inclined surfaces 46 of the end 47 of the stem 405 inside. In the locked central position of the impact tip 404 shown in FIG. 13, the adjusting pistons 41, 42, 43 are held in the neutral position by the pressure fluid supplied via the pressure lines 17 (cf. FIG. 3) to the cylinder spaces 48 and by pressure springs 49. The pressure springs 49 are arranged in recesses 50 of a centering shell 51 which encloses about half of the surface of the spherical thickening 416 of the impact tip 404; the ball joint bearing is completed by correspondingly formed inner surfaces of the stepped head 403 whose inner shell surfaces enclose the other half of the spherical thickening 416.

In order to displace the impact tip 404 to the eccentric position shown in FIG. 15 the cylinder space 48 of the adjusting piston 41 is acted on by a pressure high enough to overcome the force of the pressure spring 49 so that the pressure spring 49 acting on the adjusting piston 41 is compressed. The pressure in the cylinder spaces 49 of the adjusting pistons 42, 43 is simultaneously reduced to a value below that of the force of the pressure springs 49 associated with the adjusting pistons 42, 43. The adjusting piston 41 is displaced in the direction of the arrow 52 and the adjusting pistons 42, 43 are displaced in the opposite direction according to arrow 53. Owing to the inclined plane defined by the inclined surfaces 44 of the adjusting pistons 41, 42, 43 and the oppositely inclined slanting surfaces 46 of the impact tip 404, the impact tip 404 is displaced into the eccentric position as shown in FIG. 15. In order to adjust to the central position after the directional correction the pressure in the cylinder space 48 of the adjusting piston 41 is reduced and the pressure in the cylinder spaces 48 of the adjusting pistons 42, 43 is increased. The adjustment piston 41 is pushed forward counter to the direction of the arrow 52 by the relaxing pressure spring 49 and at the same time the pressure springs 49 associated with the adjusting pistons 42, 43 are compressed counter to the direction of the arrow 53 by the adjusting pistons 42, 43 moving forwards until the neutral starting position shown in FIG. 13 is reached.

Figure 16:
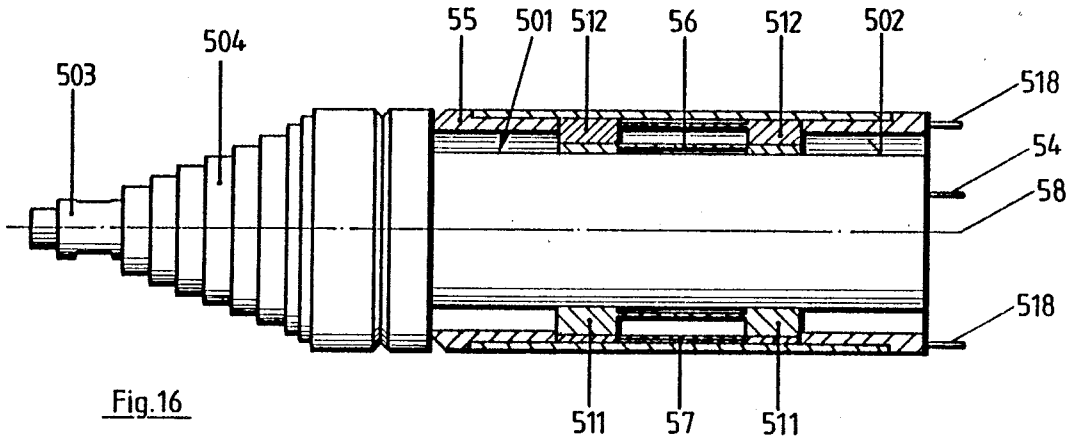
Figure 17:
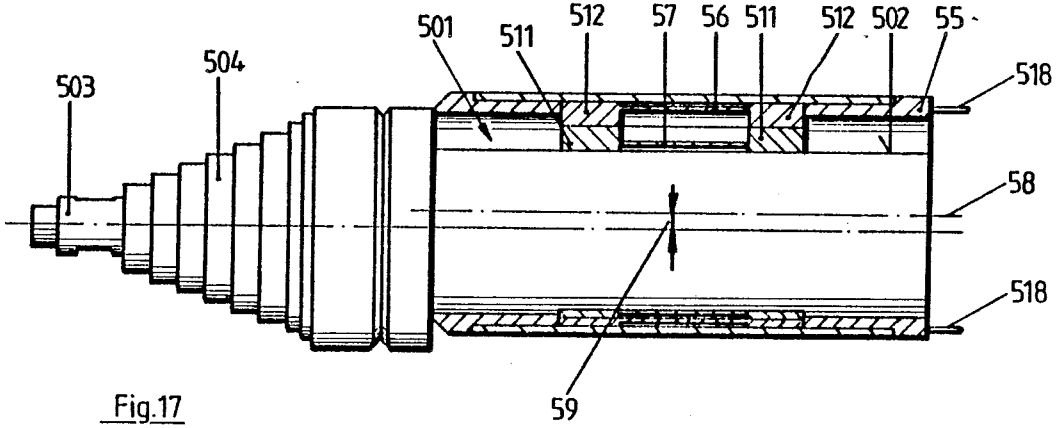
FIG. 17 shows the ram boring machine according to FIG. 16 in a position displaced about the centre axis from its central position.

In the embodiment according to FIGS. 16 and 17 a ram boring machine 501 has an impact tip 504 mounted in the tubular housing 502 of the ram boring machine 501 to be axially displaceable with its part projecting out of the housing 502 formed as a stepped head 503. The impact tip 504 has a stem (not shown) extending in the inside of the housing 502 and is pushed forward by the action of a percussion piston guided axially in the housing 502 and thereby works its way forward into the ground. In order to act on the percussion piston (not shown) with compressed air there is a reversible pressure connection 54 at the rear end of the ram boring machine 501, supplied by a compressor. With axial, forward acceleration the percussion piston strikes the stem of the impact tip 504 and thereby imparts its impact energy to the tip 504.

The ram boring machine 501 is mounted in two adjusting eccentrics spaced axially from one another which consist of eccentric rings 511, 512 fitted radially one within the other, i.e. an outer eccentric ring 512 encloses an inner eccentric ring 511. The adjusting eccentrics serving to position and radially displace the ram boring machine 501 from its central position are enclosed by a tubular casing 55 which envelops the machine housing 502 and is spaced radially from the surface of the housing, i.e. in the central position of the ram boring machine 501 shown in FIG. 16 it is arranged concentric with the machine 501. In the embodiment of the adjusting eccentrics according to FIGS. 16 and 17 the inner eccentric rings 511 and the outer eccentric rings 512 are in each case connected to one another by a tube 56 and 57 respectively. The connecting tubes 56, 57 ensure that, when displacing the ram boring machine 501 from its central position around the central axis 58, for example to the eccentric position of the ram boring machine 501 having the eccentricity 59 shown in FIG. 17, the two inner and outer eccentric rings 511 and 512 respectively are rotated in the same direction.

Figure 18:
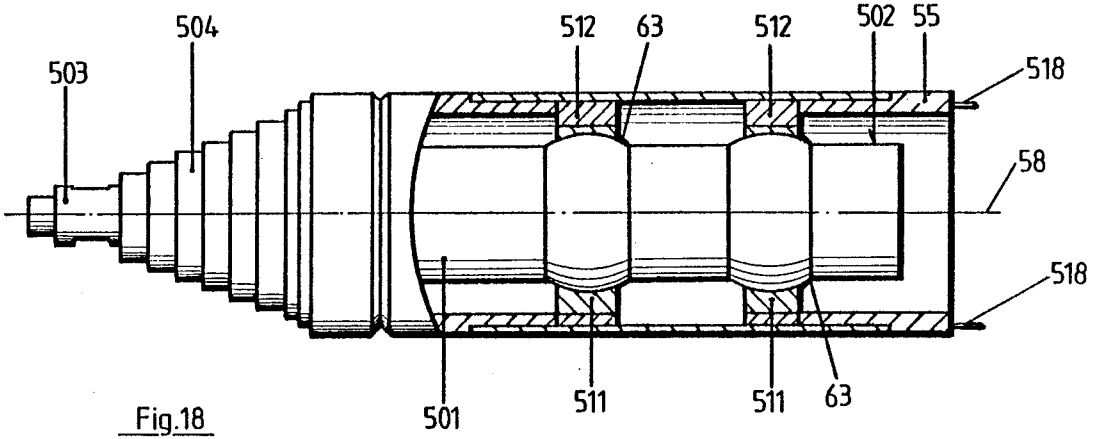
FIG. 18 shows in longitudinal section a tubular shell having two counter-rotatably adjustable adjustment eccentrics holding a ram boring machine in the central position.
Figure 19:
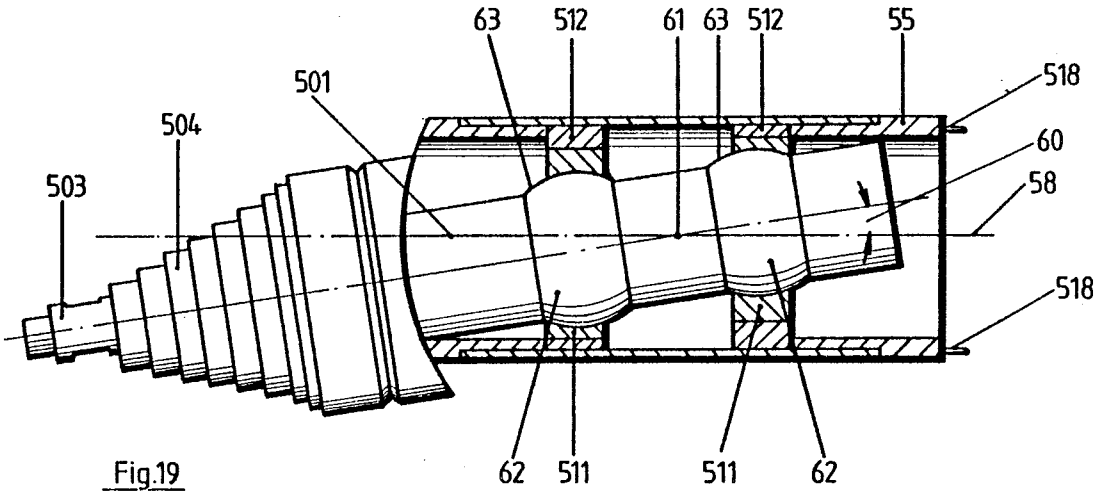
FIG. 19 shows the ram boring machine according to FIG. 18 in an inclined position displaced from its central position.

When the ram boring machine 501 is mounted, as shown in FIGS. 18 and 19, in two adjusting eccentrics, spaced axially from one another, arranged between the housing 502 of the ram boring machine 501 and the tubular casing 55 and each consisting of eccentric rings 511, 512 fitted one within the other, directional changes are achieved by steering the ram boring machine 501 as desired in any vertical and/or horizontal plane, as is shown in FIG. 19 by the ram boring machine 501 displaced in a vertical plane with an angle of inclination 60 relative to the central axis 58. In order to deflect the ram boring machine 501 horizontally and/or vertically relative to the central axis 58 the adjusting eccentrics are rotated counter to one another, i.e. while, for example, the eccentric rings 511, 512 of the adjusting eccentric next to the stepped head 504 are being counter-rotated so that the eccentricity (based on the zero setting, i.e. the central position as shown in FIG. 18) is as great as possible downwards and the eccentricity of the other adjusting eccentric is as great as possible upwards, so that the inclined position of the ram boring machine 501 shown in FIG. 19 results. Displacement of the ram boring machine 501 to an inclined position deflected horizontally and/or vertically, relative to the central axis 58, wherein the machine 501 always rotates about a point 61 on the centre axis 58 centrally between the two adjusting eccentrics, is aided by spherical housing shells 62 whose convex external surfaces 63 abut against matching, i.e. concave bearing surfaces of the inner eccentric rings 511.

Figure 20:
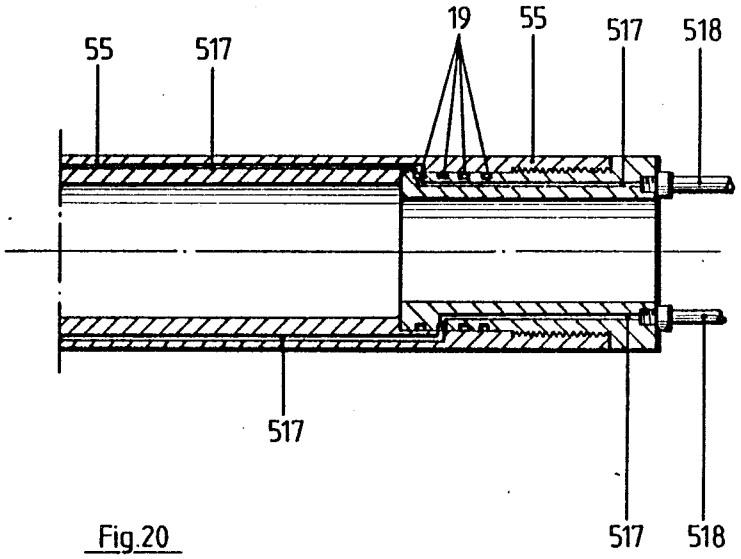
FIG. 20 shows in longitudinal section the rear end of a tubular shell, accommodating a ram boring machine, having connections and pressure lines to supply the pressure means effecting the adjusting movements of the ram boring machine (not shown)
Figure 21:
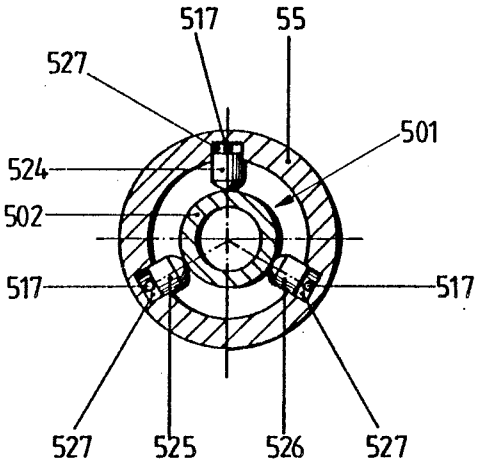
FIG. 21 shows diagrammatically, in cross-section, a plurality of adjusting pistons arranged as adjusting elements, according to the invention, radially around a ram boring machine between the surface of the housing and the tubular shell.

In order to displace the ram boring machine 501 radially, in place of adjusting eccentrics three adjusting pistons 524, 525, 526 are arranged as shown in FIG. 21 in the space between the tubular casing 55 and the surface of the machine housing 502 in a radial plane about the housing 502, their cylinder spaces 527 are connected via pressure lines 517 to supply connections 518 (cf. FIG. 20) arranged at the rear end of the tubular casing 55.

In order to displace the ram boring machine 501 from its central position into the eccentric position shown in FIG. 17 or 19, the eccentric rings 511, 512 are displaced relative to one another by means of a pressure medium, in particular hydraulic fluid. The hydraulic fluid is supplied via the pressure lines 517 shown in FIG. 20, which are arranged in the tubular casing 55 in a number corresponding to the number of control nozzles (not shown) aimed at the eccentric rings 511, 512. The pressure lines extend from the rear end of the tubular casing 55 to the adjusting eccentrics 511, 512 or in the embodiment according to FIG. 21, to the cylinder spaces 527 of the adjusting pistons 524, 525, 526.

The lines 517 are connected at the rear end of the tubular casing 55 to the supply lines 518 connected to a hydraulic tank not shown. The hydraulic fluid flowing in via the supply connections 518 is distributed by grooves 19 associated with each pressure line 517.

What is claimed is:

1. A pressure-medium driven ram boring machine for earth boring, comprising:

a machine housing;

an impact tip movable in a longitudinal advance direction and having a stem, the impact tip being adjustable radially relative to the advance direction from a normal centered position;

a striker piston arranged so as to be reciprocally movable in the housing and so as to act upon the impact tip;

at least one eccentric ring arranged in the housing so as to surround the stem with the housing and rotatably support the impact tip;

a spherical shell arranged in a matching recess in the at least one eccentric ring so as to be in area contact with a portion of an outer contour surface of the stem; and members arranged so as to enclose the at least one eccentric ring on its end faces.

2. A ram boring machine according to claim 1, wherein the at least one eccentric ring includes two relatively rotatable eccentric rings fitted radially one within the other.

3. A ram boring machine according to claim 2, wherein the eccentric rings are rotatable hydraulically.

4. A ram boring machine according to claim 3, and further comprising pressure lines arranged in the housing, leading to the eccentric rings and connected to supply connections.

* * * * *